United States Patent [19]

Sahyun et al.

[11] 4,337,303

[45] Jun. 29, 1982

[54] TRANSFER, ENCAPSULATING, AND FIXING OF TONER IMAGES

[75] Inventors: Melville R. V. Sahyun, St. Paul; Tsung-I Chen, Woodbury; Timothy W. King, Shoreview; Valdis Mikelsons, Mendota Heights; Smarajit Mitra, Woodbury, all of Minn.

[73] Assignee: Minnesota Mining and Manufacturing Company, St. Paul, Minn.

[21] Appl. No.: 177,259

[22] Filed: Aug. 11, 1980

[51] Int. Cl.[3] ..... G03G 13/16

[52] U.S. Cl. ..... 430/11; 430/13; 430/18; 430/107; 430/117; 430/126

[58] Field of Search ..... 430/117, 126, 119, 11, 430/13, 18, 107; 427/146

[56] References Cited

U.S. PATENT DOCUMENTS

| | | | |
|---|---|---|---|
| T879,009 | 10/1970 | Staudenmayer et al. | 430/126 |
| 2,143,214 | 1/1939 | Selenyl | 358/127 |
| 2,221,776 | 11/1940 | Carlson | 430/31 |
| 2,297,691 | 10/1942 | Carlson | 430/55 |
| 2,357,809 | 9/1944 | Carlson | 355/3 R |
| 2,666,144 | 1/1954 | Schaffert et al. | 430/35 |
| 2,855,324 | 10/1958 | Van Dorn | 430/126 |
| 2,886,464 | 5/1959 | Van Dorn | 430/126 |
| 2,899,335 | 8/1959 | Straughan | 430/117 |
| 2,930,711 | 3/1960 | Straughan | 430/118 |
| 3,017,560 | 1/1962 | Polster | 321/45 |
| 3,018,262 | 1/1962 | Schroeder | 260/29.2 |
| 3,036,913 | 5/1962 | Burg et al. | 430/271 |
| 3,060,023 | 10/1962 | Burg et al. | 430/254 |
| 3,247,007 | 4/1966 | Oliphant et al. | 430/117 |
| 3,419,411 | 12/1968 | Wright | 430/117 |
| 3,445,234 | 5/1969 | Cescon et al. | |
| 3,520,811 | 7/1970 | Swoboda | 252/62.54 |
| 3,620,726 | 11/1971 | Fu-Hua Chu | 430/291 |
| 3,640,749 | 2/1972 | Lorenz | 427/411 |
| 3,773,417 | 11/1973 | Pressman et al. | 355/3 R |
| 3,987,037 | 10/1976 | Bonham et al. | 260/240 D |
| 4,011,358 | 3/1977 | Roelofs | 428/287 |
| 4,026,705 | 5/1977 | Crivello | 204/159.18 |
| 4,058,401 | 11/1977 | Crivello | 204/159.18 |
| 4,071,362 | 1/1978 | Takenaka et al. | 430/126 |
| 4,101,513 | 7/1978 | Fox et al. | 526/193 |

FOREIGN PATENT DOCUMENTS

| | | | |
|---|---|---|---|
| 2020297 | 11/1979 | United Kingdom | 430/300 |

OTHER PUBLICATIONS

Ferry, Viscoelastic Properties of Polymers 2nd Ed. N.Y., Wiley (1970), pp. 18, 49.

Middleman, The Flow of High Polymers N.Y., Wiley (1968), pp. 147–149.

King et al. Photogr. Sci. Eng., 24, 93 (1980), Application of Image Quality Concepts to Electrophotography.

Sahyun, J. Photogr. Sci., 26, 177 (1978).

Meissner, Pure & Applied Chemistry, 42, pp. 575–577, (1975).

Schaffert, Electro Photography 2nd Ed. N.Y., Wiley pp. 191 (1975).

*Primary Examiner*—Richard L. Schilling
*Assistant Examiner*—John L. Goodrow
*Attorney, Agent, or Firm*—Cruzan Alexander; Donald M. Sell; Lorraine R. Sherman

[57] ABSTRACT

A method of transferring, encapsulating, and fixing dried liquid toner images in electrography is provided. Stable, abrasion-resistant articles exhibiting continuous tone and transmission optical densities within the range of 0 to 4.0 are disclosed.

25 Claims, 7 Drawing Figures

TRANSFER, ENCAPSULATING, AND FIXING OF TONER IMAGES

TECHNICAL FIELD

This invention relates to development, transfer, encapsulation, and fixing of dried liquid toner electrographic images. In another aspect, it relates to electroradiography and a method of producing stable, abrasion-resistant images of high transmission optical densities.

BACKGROUND ART

Electrography refers to the processes of electrophotography, electroradiography, and magnetography. The process of electrography has been described in numerous patents, such as those issued to Chester F. Carlson, including U.S. Pat. Nos. 2,221,776, 2,297,691, and 2,357,809. The process, as taught in these and other patents, essentially comprises production of a latent electrostatic image using photoconductive media and the subsequent development and transfer of a visible image therefrom. A latent electrostatic image may also be formed by spraying the charge onto a suitable charge-retaining surface as taught, for example, in U.S. Pat. Nos. 2,143,214, 3,773,417, and 3,017,560. In magnetography, the latent image is magnetic and may be developed with appropriately magnetized or magnetizable developer particles, as described in U.S. Pat. No. 3,520,811.

Development of the latent image can be accomplished by deposition of developer particles on the electrostatic or magnetic latent image, the most common technique using powder or cascade development, but liquid developers are also utilized in the prior art. A liquid developer comprises a dispersion of the developer particles in a suitable liquid dispersant.

Transfer of the developed image to another surface is often accomplished by means of externally applied electrostatic forces, by adhesion of the image particles to a "tacky" receptor sheet using contact and pressure, or by utilization of a resin-coated receptor sheet having a desirable transfer surface. Fixing of the transferred image is frequently accomplished by pressure, heating, and subsequently cooling to room temperature.

Starting with an image which has been freshly developed with liquid toner (dispersant is still present), transfer and fixation may be accomplished by absorption and/or electrostatic transfer, as disclosed in U.S. Pat. Nos. 3,419,411, 3,247,007, and 2,899,335. Where dispersant is still present upon transfer, the images may suffer from the problem of lateral displacement. Such a problem prevents good resolution of the image. If it is desirable to remove the dispersant, the additional problems of evaporation, heat, and safe removal of vapors are present. U.S. Patent Office Defensive Publication No. T879,009 discloses a receiving sheet with a softened surface which is pressed against an organic photoconductor bearing a liquid developed xerographic image which image retains a portion of the liquid developing solvent therein. The image transfers to the receiver during the application of heat and pressure. About 10 to 95% of the liquid developer solvent is removed, with at least 5% residual solvent required for transfer. The receiver sheets are coated with solvent-susceptible resins, which apparently "swell" in the presence of the liquid dispersant and allow the toner particles to become imbedded in the resin coating. The resin coating weight is 0.2 g/ft$^2$ (about 1.5 microns thick) compared to the preferred thicker coatings (about 3 to 100 microns) in the present invention. Smaller dimensional coatings may be used but thicker coatings are preferred in order to accommodate the higher transmission optical densities of the present invention. The highest D-max for the transferred image that is listed in the publication of 1.2. The authors note that when the toners are dried to remove essentially all of the dispersant, the transferred image is of poor quality, with only about 60–70% of the toner particles being transferred.

U.S. Pat. No. 2,930,711 discloses an electrostatic printing method in which liquid developer is used. The dispersant is "blotted" away before transfer of the image, during which process as much as 20% of the toner particles are transferred to the blotting material. The liquid-free powder image is then transferred to a paper coated or impregnated with a thermosoftening material by heat and pressure, or the dry visual image is brought into contact with an adhesive covered transfer media. As is known in the art, both of these methods of transfer depend upon "tackiness" of the receptor coating in order to achieve transfer of the toner particles. Adhesive transfer techniques may result in images having problems of durability. Such images are subject to rubbing-off. In contrast, receptor coatings of the present invention are not necessarily "tacky" but achieve transfer of toner particles due to the critical rheological properties of the receptor coatings. Also, whereas the two above-mentioned publications disclose considerable loss in toner particles (if dry transfer takes place), the present invention transfers at least 90%, and preferably at least 97%, of dried toner particles to achieve images with superior optical densities.

It is well known in the art to use dry powder toner to develop a latent electrostatic image. U.S. Pat. No. 2,855,324 discloses thermoplastic coated receptors to which a dry toner image may be transferred by contact under pressure. As mentioned above, this type of transfer may result in problems of durability. U.S. Pat. No. 3,640,749 discloses coating a transferred dry powder image and receptor with a dispersion of a synthetic resin in water. U.S. Pat. No. 4,071,362 discloses use of a receptive styrene-type resin on a thermally resistant base film to fuse with thermoplastic coated dry toner particles (i.e., image-fixing is achieved by use of a special toner). U.S. Pat. No. 3,620,726 discloses the use of pigment developer of particle size within the range 0.2–30 microns, preferably within the range of 5.0–10.0 microns, with not more than 50% of the particles being of less than 1 micron equivalent spherical diameter, thereby reducing background stain.

The present invention provides a stable electroradiographic, magnetographic, or electrophotographic image of superior optical density, clarity, and resolution, by overcoming transfer and fixing problems often present in the prior art, as noted above. The practice of the present invention is not limited to toner of particular thermoplastic or rheological properties, but depends upon encapsulation of particles in a receptor layer of critical rheological properties.

DISCLOSURE OF INVENTION

Briefly, the present invention provides for the development, transfer, encapsulation, and fixing of dried liquid toner images in electrography. More particularly, stable, abrasion-resistant, continuous tone, high maximum transmission optical density electroradiographic image-bearing articles are provided.

In the preferred embodiment, an electrostatic charge pattern representative of an electrophotographic or of a radiographic image is established on a suitable electrostatic charge retaining medium. The charge retaining layer may be a photo- or radioconductor, an insulating overlayer on the photo- or radioconductor, or an insulating layer onto which a charge image is transferred or directly sprayed. The liquid toner developed image is formed by development of an electrostatic charge pattern with a finely divided solid charged or polarizable pigment material which is dispersed in a suitable high resistivity organic liquid (e.g., a mixture of medium molecular weight aliphatic hydrocarbons, Isopar®G, Exxon Corp.). The liquid dispersant portion of the liquid toner image is then removed (e.g., by evaporation) leaving a dried toner image representative of the electrostatic charge image. Where the liquid toner developed image is formed by development of a magnetic pattern, finely divided opaque magnetic or magnetizable pigment material is dispersed in a suitable liquid (e.g., water or hydrocarbons).

Pressure is then utilized to transfer the dried liquid toner image to a preferably transparent substrate bearing a transparent receptor coating which has a Newtonian complex dynamic melt viscosity (i.e., the dynamic melt viscosity is shear rate independent) of less than about $1.7\pm0.2\times10^3$ poise and a loss tangent greater than 10 at the temperature of transfer. As a result of this transfer step, the toner image is encapsulated in depth into the receptor coating. The encapsulated toner image is then fixed into place within the receptor coating by returning it to room temperature and/or by application of curing radiation. Stable, abrasion-resistant images having continuous tone and capable of maximum transmission optical densities in the range of 1.2 to 4.0 are produced. By "encapsulation" as used herein it is meant that at least 75%, and preferably at least 90%, of the particles transferred do not protrude out of the surface of the polymeric receptor coating.

As mentioned above, liquid electrographic developers are known in the art. Typically the pigment particles therein are sub-micron in spherical diameter. Much of the prior art utilizes dry powder toners wherein particle diameter is typically at least 5 to 20 microns. Although such dry toners are easier to handle and overcome problems such as inconsistency of results due to solvent evaporation, lateral image displacement, necessity for removal of vapors, etc., generally present when liquid toners are used, the liquid developers allow higher photographic sensitivity, dynamic range, and resolution.

Electrography has been adapted to include the recording of medical radiographs. (See Schaffert, *Electrophotography,* 2nd Ed., New York, Wiley (1975) pp. 191 ff, and assignee's copending patent application U.S. Ser. No. 963,897, filed on Nov. 27, 1978, in the names of O. L. Nelson and V. Mikelsons). Use of a liquid developer is crucial to obtaining the requisite resolution and sensitivity in the imaged article. In order for the electroradiograph to be acceptable for diagnostic purposes, it must exhibit a continuous tone transmission optical density range of at least 0 to 2.0, preferably 0 to 3.0, thereby providing contrast in the resulting image. The developed toner image of such an electroradiograph must undergo linear transfer in order to preserve the optical density range and sensitivity of the original image. Linear transfer occurs when the percent of toner transferred is independent of the initial developed optical density.

Liquid toner images, however, upon transfer with dispersant still present, require a porous substrate or they are subject to lateral displacement. To overcome this and other disadvantages noted above, and to retain the benefit of sub-micron toner particle size, the present invention provides for removal of up to 100% of the liquid dispersant portion of the liquid toner image before transfer of the image.

Toner deposits, whether dry or liquid, have been described [M. R. V. Sahyun, J. Photogr. Sci., 26, 177 (1978); T. W. King, O. L. Nelson and M. R. V. Sahyun, Photogr. Sci. Eng., 24, 93 (1980)] as representing a series of at least partially ordered, superposed layers of particles. Each layer constributes approximately 0.4 to the observed transmission optical density or approximately 0.8 to the observed reflection density. Thus, the electrographic applications of the prior art, document copying, photographic printing, and proofing, etc., which typically yield maximum reflection densities of approximately 1.5, require not more than two layers of toner particles to form the image. The radiographic application, as described above, would correspondingly require an eight-layered deposit. In such an application, the high density, transmissively viewed deposit cannot be fixed to the surface of the transparent substrate unless some self-adhesive or thermoplastic character is imparted to the toner particles themselves. This requirement limits the toner materials choices to the potential detriment of both sensitivity and image quality.

The present invention provides a process whereby the charge pattern comprising a latent image typical of an electrograph, e.g., an electroradiograph (but not limited thereto), can be developed with a liquid developer dispersion, and the resulting dried liquid toner deposit transferred to a separate coated, transparent substrate, then encapsulated and fixed thereon, preferably by irradiation, to provide a stable, abrasion-resistant image. This procedure may provide linear transfer of dried toner images having transmission optical densities in the range of 0 to 4.0. Articles having transmission optical density ranges 0 to 4.0, 0 to 3.0, 0 to 2.0, and 0 to 1.5 are useful depending on the technical area in which the reproduction is to be used. This invention also provides an article capable of high resolution, e.g., about 200 lp/mm.

DETAILED DESCRIPTION OF THE INVENTION

The present invention provides a method of electrography comprising the steps of:

(a) providing a substrate carrying a liquid toner image on at least one surface thereof, (b) removing, such as by evaporation, the liquid dispersant from said liquid toner image so that the toner material is converted to a dried toner image composition comprising at least 50% by weight of solids, (c) bringing said dried toner image into contact with a soft or softenable receptor coating on a substrate, applying pressure and, optionally, heat so that said dried toner image undergoes linear transfer and becomes encapsulated within the soft or resulting softened receptor coating, the material comprising said soft or softened receptor coating having a Newtonian complex dynamic melt viscosity of less than about $1.7\pm0.2\times10^3$ poise and a loss tangent greater than 10, measured as described below, at the temperature of transfer, and (d) hardening the receptor coating.

Figure 1:
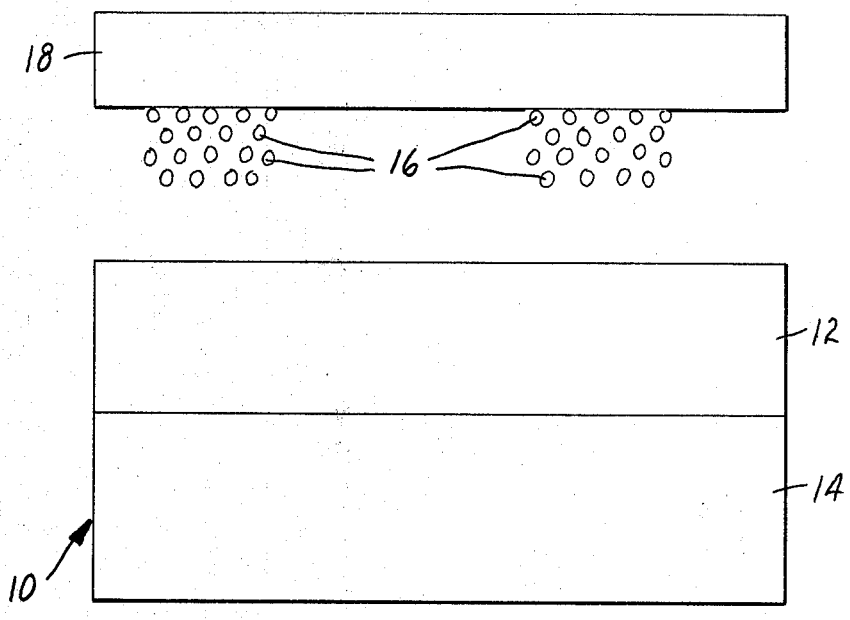
FIG. 1 is a schematic elevational view of the transfer set (layer comprising dried liquid toner developed image and receptor layer) prior to transfer of the image.

Referring now to FIG. 1, the receptor 10 comprises a transparent support 14, e.g., a polymeric material such as polyester, polymethylmethacrylate, cellulose triacetate, polyethylene, polystyrene film, or glass, bearing on one side a toner encapsulating coating 12, which preferably is about 3 to 100 microns thick, and most preferably is 10 to 50 microns thick. Non-transparent supports such as paper or aluminum may also be used. One or more primer layers, to promote adhesion of the coating 12 to the support 14 (and thereby help prevent transfer of the coated material to the photoreceptor surface), may optionally be included. Typical primer layers have been described in U.S. Pat. No. 3,036,913; polymeric coatings on typical primed supports have been described in U.S. Pat. No. 4,011,358. Optionally, on the reverse side of the support may be coated a low adhesion backsize to prevent blocking of the coating when rolled up or stacked in sheets. The dried liquid toner image deposit 16 on the photoconductor 18 is shown just prior to transfer of the image deposit to the receptor coating 12.

Figure 2:
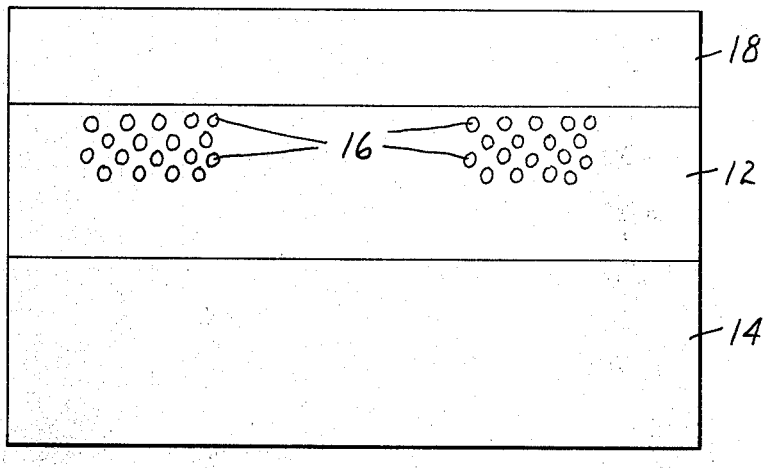
FIG. 2 is a schematic elevational view of the set immediately after encapsulation of the image.
Figure 3:
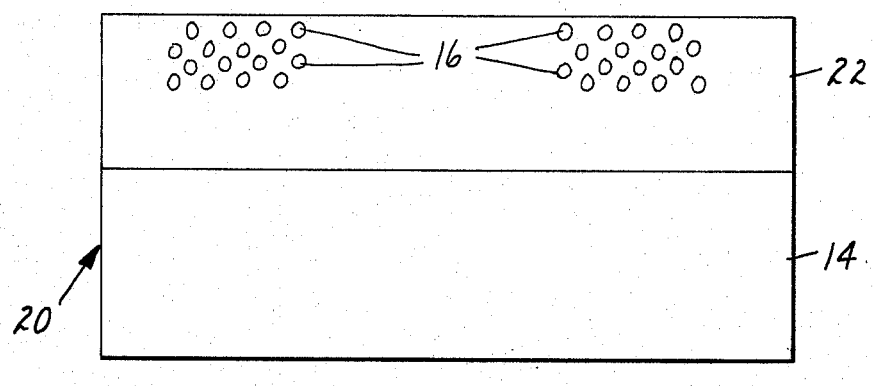
FIG. 3 is a schematic elevational view of the cured article produced according to the method of this invention.

FIG. 2 shows encapsulation of the dried liquid toner image deposit in the receptor coating upon transfer. As mentioned above, at least 75% and preferably at least 90% of the particles transferred do not protrude out of the surface of the polymeric receptor coating. Subsequent to transfer, the toner image particles are fixed into place either by cooling, if receptor layer 12 is a heated thermoplastic, or by curing, e.g., using ultraviolet radiation, if receptor layer 12 is a photopolymer, to form, as is shown in FIG. 3, a stable image-bearing layer 22 which in combination with transparent support 14 provides a stable, abrasion-resistant, image-bearing article 20 capable of providing a maximum transmission optical density of at least 3.0 for radiographic applications. Images prepared according to this invention usually appear glossy, particularly as compared to images of prior art systems which appear flat or dull.

In addition to their appearance, transferred images produced by the encapsulation and fixing of the present invention may be distinguished from adhesively transferred images of the prior art by other experimental means. Scanning electron microscopy (SEM), with magnifications of from 1000× to 30,000×, has proved especially useful in defining the limiting cases of the transfer mechanism. It can be shown that with pure encapsulation transfer, the individual toner particles of substantially submicron size retain their integrity and are not subjected to gross deformation. This technique provides a clear cut distinction between encapsulation transfer and adhesion transfer. The SEM allows determination of the distribution of the toner material in depth in the receptor coating as well as its morphology. With adhesive transfer the transferred toner can be found, regardless of optical density, within a depth of about 1–1.5 microns of the first surface of the receptor layer 12, with a substantial portion of deformed particles on the surface, using a toner having a mean particle diameter of approximately 0.4 micron. On the other hand, with encapsulation transfer, toner particles may be found as a homogeneous continuum of particles extending as deep as 3 to 4 microns for toner of the same particle diameter, i.e., ca eight particle-diameters. Essentially no toner particles protrude through the surface of the coating as evidenced by scanning electronmicrographs. SEM evaluation of samples also showed that for receptor coating thicknesses greater than approximately 10 microns, the encapsulation transfer of deposits of the 0.4 micron mean diameter toner was independent of coating thickness.

Figure 4:
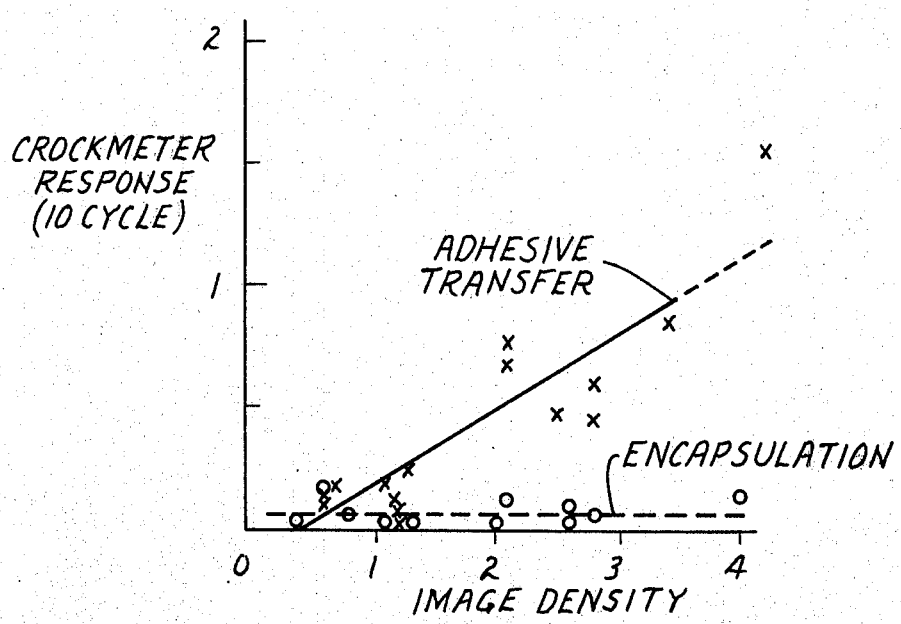
FIG. 4 is a graph demonstrating the improved abrasion resistance of an encapsulated image.

The encapsulation mechanism of transfer has a direct bearing on the abrasion-resistance of the final, fixed image. This characteristic is measured with a standard AATCC Crockmeter (manufactured by Atlas Electric Devices Co.), typically in a 10 cycle test. A more positive response means more material removed, hence undesirably lower resistance to abrasion. In runs using materials selected from the thermoplastic receptor examples, the Crockmeter responses of images transferred by adhesion and encapsulation (as established by SEM) were evaluated. Independent of the specific material used in the receptor coating, Crockmeter response for adhesion transferred samples increased monotonically with optical density. Using standard statistical techniques, a regression line of correlation coefficient, $r=0.876$ for 14 data points, was established for the adhesion samples. Crockmeter response of encapsulation transferred samples, on the other hand, was independent of optical density, and at a level achieved by adhesion transfer only at optical densities typical of transfer of one monolayer of toner. These data are graphed and are shown in FIG. 4.

Transfer by adhesion depends on the surface characteristics of the receptor coatings, and specific receptor-toner interactions; it usually requires a "tacky" material. On the other hand, encapsulation depends on bulk mechanical properties of the material comprising the receptor coating, and according to the present invention this material should be a viscoelastic liquid under the conditions of transfer. As defined by Ferry [*Viscoelastic Properties of Polymers,* 2nd Ed., New York, Wiley (1970) p. 18], such materials may yet possess sufficiently high viscosities so as to appear to be solids or semi-solids, but may be recognized rheologically by a high value of the loss tangent, i.e., tan $\delta$ is much greater than 1 (Ferry, pp. 49 ff).

Rheological evaluation of receptor materials wherein toner transfer occurred by adhesion or by encapsulation was carried out on a Rheometrics, Inc. mechanical spectrometer. This instrument was calibrated to yield rheological functions in agreement with the standard published ones as described in Meissner, Pure and Applied Chemistry, 42, pp. 575–7 (1975), for the IUPAC standard low density polyethylene sample A. A stress of 2 kg was applied at a frequency of 10 rad $sec^{-1}$ with the samples sandwiched between parallel plates of 50 mm diameter spaced with a gap of 0.3 mm. The stress frequency was selected to correspond to the rate at which toner is introduced into the receptor layer during lamination of the toner bearing photoreceptor to the receptor coating at a typical speed of 1 cm $sec^{-1}$. Some samples were evaluated over a range of stress frequencies from 3.0 to 30.0 rad $sec^{-1}$ in order to establish their conformance to Newtonian behavior. As used herein, Newtonian behavior means that the melt viscosity of the material is shear rate independent. Observations over the stress frequency range of 3 to 30 rad $sec^{-1}$ confirm that those materials which allow encapsulation are Newtonian, whereas the adhesive transfer materials are not, as shown in Table I.

molecular relaxation times put an upper limit on the shear rates at which Newtonian behavior is observed in polymer systems. [Middleman, *The Flow of High Polymers,* New York, Wiley (1968) pp. 147–149]. Thus the receptor material choice puts an upper limit on the rate at which the transfer process may be effected. This limitation may be overcome, however, by effecting lamination of the toner image-bearing donor to the receptor more rapidly, but subsequently maintaining these two elements in their intimate relationship at a temperature above $T_{trans}$ for a sufficient period of time (e.g., 0.5–30 sec) to allow the necessary molecular relaxations to take place. The sequence of events just described is contemplated as being within the scope of the invention.

TABLE I

Rheological Evaluation of Transfer Materials

| Sample No | Formulation | $T_{trans}$(±5° C.) | $\eta^*$(poise) | Tan δ | Newtonian |
|---|---|---|---|---|---|
| | ADHESIVE TRANSFER | | | | |
| 1 | Piccolastic ®D 125[a] | 110° | $1.4 \pm 0.8 \times 10^4$ | 1.3 | no |
| 2 | Cpd I (see TABLE II) (9 parts) - Epon 1004[b] (1 part) | 22° | $1.2 \pm 0.55 \times 10^4$ | 3.5 | — |
| 3 | Epon ® 1001[c] | 110° | 60 ± 30 | 4 ± 1.5 | no |
| 4 | Cpd I (4 parts) - Epon 1004 (1 part) | 30° | $1.0 \pm 0.15 \times 10^4$ | 5 | — |
| 5 | SIA[d] resin (3 parts) - polystyrene[e] (1 part) | 95° | $7 \pm 3 \times 10^3$ | 7 ± 3 | — |
| 6 | SIA resin (1 part) - polystyrene (1 part) | 80° | $0.7 \pm 0.3 \times 10^3$ | 8 ± 3 | — |
| 7 | SIA resin | 80° | $3.1 \pm 1.2 \times 10^3$ | 13 ± 4 | — |
| | ENCAPSULATION TRANSFER | | | | |
| 8 | Same as Example 6 | 55° | $2.7 \pm 1.2 \times 10^3$ | 8± 3 | yes |
| 9 | Epon ® 1001 | 75° | $2.9 \pm 1.9 \times 10^3$ | 9.5 ± 1.5 | yes |
| 10 | Same as Example 4 | 55° | $1.8 \pm 0.9 \times 10^3$ | 18.5 ± 8 | yes |
| 11 | Cpd II (2 parts) (see TABLE II)/Elvacite ® 2041[f] (1 part) | 50° | $3.4 \pm 2 \times 10^3$ | 20 | — |
| 12 | SIA resin (1 part) - polystyrene (3 parts) | 80° | $1.1 \pm 0.6 \times 10^3$ | 21 ± 6 | — |
| 13 | Polystyrene (9 parts) - paraffin (1 part) | 75° | — | 23 ± 10 | yes |
| 14 | Cpd I (9 parts) - Epon 1004 (1 part) | 40° | $1.9 \pm 1.1 \times 10^3$ | 25 | — |
| 15 | Cpd I (3 parts) - Epon 1004 (2 parts) | 55° | $1.5 \pm 0.8 \times 10^3$ | 40 | — |
| 16 | Cpd I (4 parts) - Epon 1004 (1 part) | 50° | $1.2 \pm 0.6 \times 10^3$ | 40 | — |
| 17 | SIA resin | 95° | $1.0 \pm 0.4 \times 10^3$ | >40 | — |
| 18 | Carnabu wax (m.p. 78° C.) | 80° | — | ∞ | — |

[a]Polystyrene, believed to have average molecular weight ca 5000, obtained from Hercules, Inc.
[b]Shell Chemical Co. epoxy end-capped polyether, epoxy No. 850-975
[c]Shell Chemical Co. epoxy end-capped polyether, epoxy No. 450-550
[d]55/37/8 Styrene/iso-octyl acrylate/acrylic acid copolymer, intrinsic viscosity 0.126 dl/g
[e]Polystyrene, m.w. (avg.) 2000, dispersity 1.13
[f]High m.w. polymethylmethacrylate (DuPont Corp.)

Figure 5:
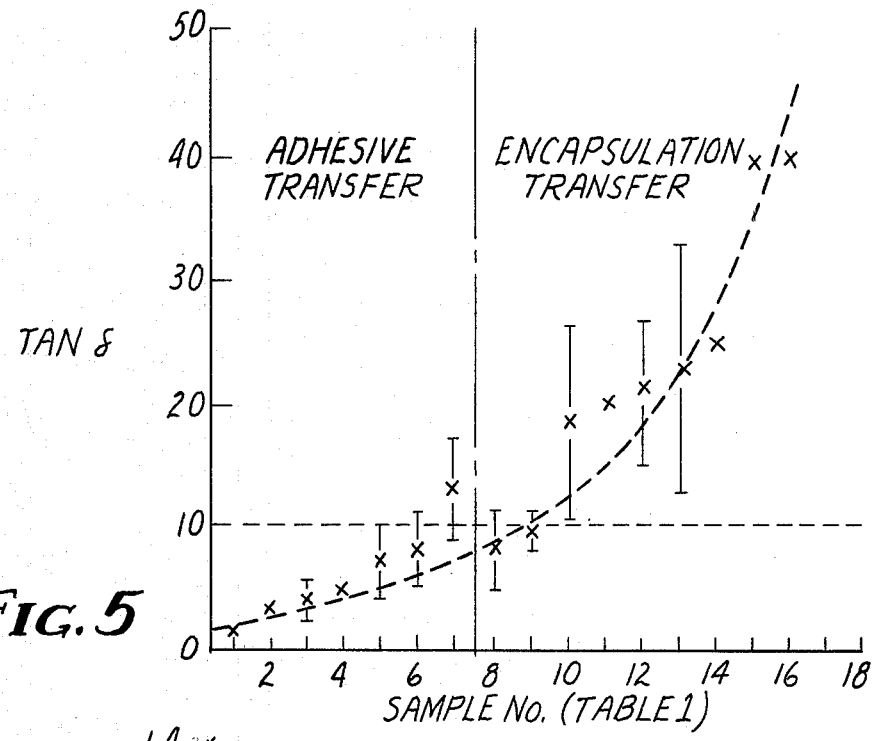
FIG. 5 is a graph demonstrating a threshold in loss tangent at which transfer by encapsulation takes place.
Figure 6:
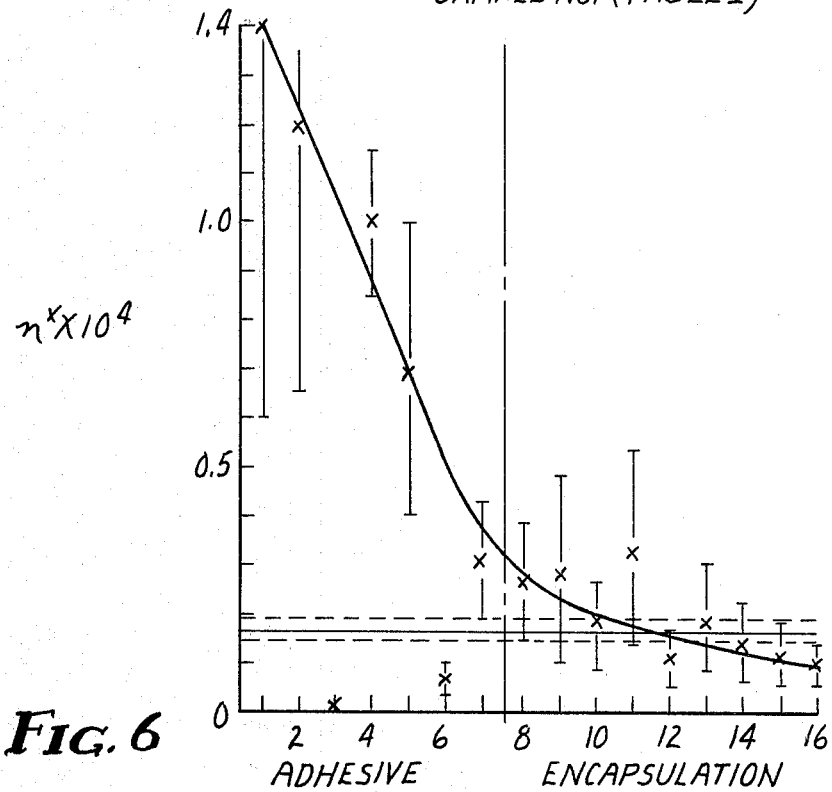
FIG. 6 is a graph demonstrating a threshold in complex dynamic melt viscosity at which transfer by encapsulation takes place.

Data were recorded at the lowest temperature at which transfer could be effected reproducibly, $T_{trans}$, in order to obtain threshold parameters since, with most materials, tan δ tends to increase with temperature while complex dynamic viscosity, $\eta^*$, tends to decrease. The data are given in Table I, wherein the confidence limits on $\eta^*$ correspond to the ±5° C. uncertainty in $T_{trans}$. Note that a given receptor material may behave as both an adhesion receptor and as an encapsulation receptor, with different values of $T_{trans}$ characteristic of each mechanism, however. Referring to FIG. 5, it can be seen that under the conditions of measurement, tan $\delta > 10$ is a threshold for transfer by encapsulation. It also appears from the rheological evaluation data of TABLE I as presented in FIG. 6, that for materials which permit transfer by encapsulation, temperatures at or above that where $\eta^*$ is approximately $1.7 \pm 0.2 \times 10^3$ poise are required. Receptor coatings coming within the scope of this invention have a Newtonian complex dynamic melt viscosity of less than about $1.7 \pm 0.2 \times 10^3$ poise and a loss tangent greater than 10, measured as described above, at the temperature of transfer.

The transfer rate is critical to obtaining encapsulation, and it is related to the shear rate at which the rheological properties are evaluated. Characteristic The temperature of transfer according to the process of the present invention is defined as a temperature below 180° C. It is preferred that the transfer process occurs at temperatures up to 130° C. (above which temperature typical support materials, e.g., polyester films, tend to soften and deform); it is most preferred that the range of 20°–70° C. be used, both to conserve energy and to limit the extremes of temperature to which the photoreceptor, on which the image is originally developed, is subjected. Amorphous selenium, a photoconductor of choice for many applications, crystallizes when heated above 65° C., thereby forfeiting its photoconductive properties. Other useful photoconductors, such as amorphous chalcogenides, or dispersions of inorganic pigments, such as lead oxide, are also damaged when subjected to high pressures, as is necessary in some toner transfer techniques of the prior art. For example, transfer of toner to a thermoplastic receptor by the adhesive mechanism requires typically the application of pressure of 50 to 150 $kg/cm^2$; similar forces are required for the pressure fusing of dry toner deposits. On the other hand, in carrying out the process of the present invention, the toner is encapsulated on application of, typically, 1 to 5 $kg/cm^2$.

It is desirable that encapsulating coating materials exhibit the requisite viscoelastic properties (i.e., Newtonian complex dynamic melt viscosity of less than about $1.7 \pm 0.2 \times 10^3$ poise and a loss tangent of greater than 10) at the desirable lower temperature (i.e., 20°-70° C. range) and be stable and hard enough at room temperature to provide adequate protection to the image from abrasion, e.g., scratching, fingerprinting, denting, etc.

A preferred embodiment of the encapsulating coating 12 (see FIG. 1) of the present invention is a radiation curable photopolymer. In such a case, the fluid properties can be suppressed by formation of a highly cross-linked structure in the coating after transfer through the application of radiant energy. Hence, it is desirable to include in the formulation oligomers or monomers which possess a plurality of functional groups, e.g., ethylenic unsaturation, such as acrylates (see U.S. Pat. Nos. 3,018,262 and 3,060,023) and styrenes, epoxies (see U.S. Pat. Nos. 4,058,401 and 4,101,513), etc., the cross-linking reaction of which can be initiated by irradiation in the presence of a suitable initiator. In order to obtain uniform curing it is most preferable that the receptor coating not exceed 50 microns in thickness.

Suitable radiation curable encapsulating coatings can be formed from the material in TABLE II, by combining the cross-linkable materials I to V with initiators VI and VII. Compound VI and related structures (see U.S. Pat. No. 4,026,705) are especially useful to initiate cross-linking via cation active functionalities, e.g., epoxy groups as in Compound II, when sensitized as described in the Examples below and in the just mentioned patent, while compound VII is primarily a free radical progenitor, useful with ethylenically unsaturated prepolymers, such as compounds III, IV, and V. Other useful initiators have been described in U.S. Pat. Nos. 3,987,037 and 3,445,234. The cross-linkable compositions in this table are not meant to be inclusive. Other radiation curable materials having viscoelastic properties mentioned above are clearly within the scope of this invention.

TABLE II

| Compound | |
|---|---|
| | Cross-linkable Materials |
| I | OCP[k] |
| II | 3,4-epoxycyclohexylmethyl-3,4-epoxycyclohexane carboxylate, ECHM (ERL 4221, Union Carbide Corp.) |
| III | Hydantoin hexaacrylate, HHA[l] |
| IV | Triethylene glycoldiacrylate, TGD (Sartomer® 272, Sartomer Resins, Inc.) |
| | Initiators |
| V | Pentaerythritol tetraacrylate, PTA (Sartomer® 295, Sartomer Resins, Inc.) |
| VI | Diphenyl iodonium hexafluorophosphate, DIH |
| VII | Benzil dimethylketal, BDK (Irgacure® 651, Ciba-Geigy Corp.) |

[k]Oligomeric carboxylated polyacrylated material formed by the reaction of a polyol with a diisocyanate which is subsequently reacted with hydroxy-containing carboxyl and polyacrylate groups, as disclosed in assignee's parent application, U.S. Pat. No. 901,480, filed 1 May 1978, now abandoned, and in continuation-in-part application U.S. Pat. No. 015,586, filed 27 February 1979, as shown in preparation 4, and in assignee's British Patent No. 2,020,297.

[l]Structure and preparation disclosed in assigness's copending patent application, SN 51,876 filed 25 June 1979, in the name of Larry A. Wendling, EXAMPLE 1, incorporated herein by reference.

Typical forms of curing radiation are ultraviolet, visible light, and electron beam. Of these, ultraviolet radiation is preferred. This fixing process requires typically 10-1000 mJ $cm^{-2}$, and is very energy efficient compared to thermal fixing of thermoplastic toners.

Figure 7:
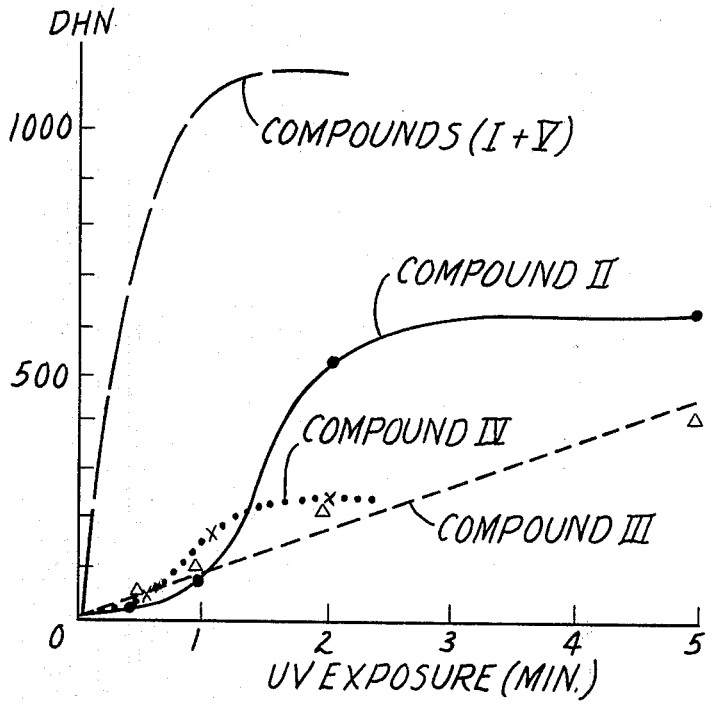
FIG. 7 is a graph demonstrating the hardness of various photocatalyzed receptor layers in which the cross-linkable materials are the compounds indicated in TABLE II.

After toner transfer, encapsulation and photocatalysis, the hardness of image-bearing layer 22 of FIG. 3 can be determined by the Dornberg hardness test which measures the force which must be applied to a standard sapphire stylus to cause its complete penetration of the image-bearing layer. The results, graphed in FIG. 7 as relative hardness (DHN) measured as just described versus time of ultraviolet irradiation, for compositions based on prepolymers of Compounds I-V of TABLE II, can be compared to a target value of 200 for hardness, estimated to be equivalent to that exhibited by a conventional, aldehyde hardened gelatin-silver halide emulsion coating on polyester base. It can be seen that less than 3 minutes of exposure to ultraviolet radiation resulted in full radiation curing for all compounds graphed. A blend of compounds I and V (I+V) needed only 30 seconds to 1 minute of ultraviolet radiation for full curing.

Objects and advantages of this invention are further illustrated by the following examples, but the particular materials and amounts thereof recited in these examples, as well as other conditions and details, should not be construed to unduly limit this invention.

EXAMPLE 1

A slurry of lead oxide pigment, styrene-butadiene resin binder (Goodyear Pliolite® S-7), and toluene was prepared with a 10:1 pigment-to-binder ratio. The slurry was coated onto a 25 micron thick polyester foil. When dry, the coating was approximately 50 microns thick. The dried coating was then overcoated with a slurry of carbon black and polyvinylbutyral resin in methanol to provide an electrically conductive contact. The ratio of carbon black to the resin was 1:1 by weight. With the polyester surface exposed, this layered structure was then mounted onto an aluminum plate so that the carbon coating made contact therewith. A second 25 micron polyester foil was then laminated to this exposed polyester surface, with a thin layer of dielectric fluid (mixture of medium molecular weight aliphatic hydrocarbons, Isopar® G, Exxon Corp.) in between to insure electrical uniformity.

The new polyester surface was then wetted with isopropanol and contacted with the aluminum surface of a conformable electrode consisting of aluminum vapor coated 25 micron thick polyester. Uniform contact was assured by drawing a squeegee across the back of the conformable contact electrode to provide a thin, uniform interface film of isopropanol.

In a darkened environment, a voltage of 1 kV was applied across the device such that the top conformable electrode was at the negative polarity. Simultaneously to the voltage application, the device was subjected to imaging radiation. When using X-rays to image, an 80 $kV_p$ source, 1 sec, 25 ma exposure with a 100 cm source-to-device distance was used. Immediately after exposure to imaging radiation, the applied voltage was reduced to zero, and the conformable top electrode was removed by peeling at a rate of approximately 25 cm $sec^{-1}$.

After the conformable top electrode was removed and the isopropanol evaporated under ambient conditions, the room lights were turned on and the image-related charge pattern was developed with a liquid toner dispersion, LTD, comprising opaque positively charged toner particles of mean diameter 0.4 micron dispersed in dielectric fluid (Isopar® G, Exxon Corp.).

After the dispersant had evaporated from the developed image to leave a matte-appearing toner deposit, the polyester foil bearing the image was removed from the rest of the device. The unfixed image exhibited a net developed transmission optical density of 4.2.

A receptor layer was prepared by coating polystyrene (average MW 2000, dispersity 1.13) plasticized with 10 wt% paraffin wax, at 20% solids from toluene onto a 100 micron primed polyester substrate. The 15 micron thick coating was dried by brief heating above 65° C. The coating was then drawn face-to-face with the image bearing substrate at a speed of approximately 0.25 cm $sec^{-1}$ between laminator rolls, one of which comprised a silicone rubber surface heated to 130° C., while the other possessed a polished metal surface. After cooling to room temperature, the polyester supports were separated to yield the toner image entirely encapsulated in the hard, glossy polystyrene coating. The encapsulated image exhibited a net transmission optical density of 3.7.

EXAMPLE 2

An electrophotographic latent image was simulated by contact charging various regions of the surface of a 25 micron thick polyester insulating foil to various negative surface potentials. To this end, the polyester foil was brought into intimate contact with a grounded aluminum base plate with a thin layer of isopropanol in between to insure electrical uniformity. A conformable electrode was then laminated to the desired region of the polyester surface as described in Example 1 and brought to a potential of about −60 V. The electrode was mechanically removed and the isopropanol allowed to evaporate under ambient conditions to leave a charge pattern on the surface. This charge pattern was then developed with the liquid toner LTD. The toner image was allowed to dry, and the polyester foil removed from the aluminum base plate. The toner deposit exhibited a maximum transmission optical density of 3.0.

A receptor was prepared by coating:

| | |
|---|---|
| Solution A | 1 part |
| Solution B | 3 parts |

where solution A comprised the polystyrene of Example 1 (22.75 wt%) and paraffin wax (2.25 wt%) in toluene, and solution B comprised a copolymer of styrene (55%), isooctyl acrylate (37%), and acrylic acid (8%) at a concentration of 25 wt% in a 30/70 isopropanol/toluene mixture, on a biaxially oriented, heat-set coextruded support film. The resulting article was as described in U.S. Pat. No. 4,011,358, and the support film corresponded to Example 7 therein. The dried, image receiving layer was approximately 3 microns thick.

A 5 cm strip of the polyester foil bearing the toner deposit was laminated face-to-face with the above receptor, using a hard rubber roller, on the surface of a Kofler Heizbank® device, a polished, heated, metal block whereon its calibrated surface temperature varies linearly along its length. Encapsulation of the toner deposit in the receptor layer to yield a net transmission optical density of 2.6 and a glossy surface, occurred at Heizbank device surface temperatures from 80° C. to 130° C., the limit to the dimensional stability of the receptor substrate.

A region of the simulated image exhibiting unit net developed density was similarly transferred over the same temperature range to yield a net transferred density of 0.8. This result demonstrated that both transfer efficiency and useful temperature range were independent of the optical density of the image being transferred.

EXAMPLE 3

A receptor coating composition was prepared from the following:

| | |
|---|---|
| pentaerythritol tetraacrylate (PTA) | 16 g |
| OCP (62.4% in methyl ethyl ketone) | 32 g |
| epoxy end capped polyether, Epon® 1004 | 8 g |
| DIH | 0.8 g |
| Diethoxy anthracene | 0.4 g |
| Fluorochemical wetting agent (F.C. 430, available from 3M) | 0.8 g |
| trichloroethane | 68 g |

The mixture was knife coated in the dark on 175 micron thick polyester photographic film base, which was primed and bore a gelatin subbing layer, to yield a 30 micron thick photocurable receptor after drying.

A photoconductor-insulator construction comprising a 25 micron thick polyester foil, a 50 micron thick layer of photoconductive cadmium sulfide dispersed in a styrene-butadiene copolymer with a pigment-to-binder ratio of 10:1, and a conducting layer comprising a dispersion of carbon black in polyvinyl butyral was assembled and mounted on an aluminum base plate as described in Example 1. The device was elaborated by laminating a second 25 micron thick polyester foil to the insulating surface thereof with a thin layer of dielectric fluid (Isopar® G, Exxon Corp.) between the layers. The entire construction was dark adapted and contact charged to −1 kV, as in Example 1, using a transparent, conformable electrode comprising a thin conductive layer of indium oxide on a polyester dielectric film (Teijin TM® film, Teijin, Ltd.), laminated to the polyester surface with isopropanol.

With the charge applied, the device was imaged through the transparent electrode to a pattern projected by an Omega B22 photographic enlarger (incandescent source), with 10× magnification. A one second exposure at f/8 was used, corresponding to approximately 1.6 m-can-sec illuminance at maximum. After exposure, the conformable electrode was removed and the isopropanol allowed to evaporate in the dark. The entire construction was then flooded with light and, with application of a −525 volt bias potential, developed under room light with the liquid toner LTD.

The image was allowed to dry under ambient conditions, and the image-bearing foil was then removed from the permanent photoconductor-insulator construction. This foil was then laminated with the photocurable receptor on a hot plate surface at 50° C. After cooling to room temperature, the combination was irradiated through the donor substrate for 30 seconds with a 30 watt ultraviolet fluorescent source. The donor substrate was then easily removable leaving a hard, clear receptor coating with the toner image encapsulated therein. Attempted transfer of a similarly formed image at room temperature yielded primarily adhesive transfer so that the image was not fixed, even after radiation curing.

EXAMPLE 4

A vapor-deposited, amorphous selenium plate was charged and imaged by X-ray exposure, as described by Schaffert et al. in U.S. Pat. No. 2,666,144. The image was developed using liquid toner LTD. The dispersant was allowed to evaporate to leave a dried, matte-appearing toner deposit on the selenium surface.

A receptor was coated as described in EXAMPLE 2. The coating composition comprised:

| | |
|---|---|
| PTA | 8 g |
| OCP (62.4% in methyl ethyl ketone) | 16 g |
| epoxy end capped polyether (Epon® 1007, Shell Chemical Co.) | 20 g |
| DIH | 0.4 g |
| 9,10-diethoxyanthracene | 0.2 g |
| fluorochemical wetting agent (FC-430, available from 3M) | 0.4 g |
| dichloromethane | 58 g |

A piece of this dried coating was preheated to 55–60° C. on the surface of a hot plate under subdued light, then laminated immediately to the image-bearing selenium plate by application of approximately 1 kg/cm$^2$ with a rubber roller. The laminate was then cured by ultraviolet irradiation as described in Example 3 through the receptor substrate. After irradiation, the receptor was easily removed from the selenium surface and left no residue thereupon. The receptor coating was hard and glossy, and the toner image was shown by SEM to be encapsulated therein.

EXAMPLE 5

A toner image of maximum transmission optical density 4.0 was formed on a 25 micron thick polyester intermediate layer selectively charged and developed according to the method of EXAMPLE 2. After development, the dispersant was allowed to evaporate until the toner deposit acquired a matte appearance. A receptor comprising carnauba wax, 6 microns thick on a 100 micron thick primed polyester support, was prepared by coating a solution of the wax, 4 wt% in xylene at 55° C., on the polyester foil using a No. 34 Meyer Bar. The coating, after air drying, was heated briefly at 80° C. to complete drying and clarify the initially hazy coating. The coating was laminated face-to-face with the polyester substrate bearing the toner image using a hard rubber roller with the receptor on a polished metal block heated to approximately 125° C. After the resulting sandwiched layers had cooled, the substrates were separated. The toner image was completely transferred to the wax coating, wherein it exhibited a maximum transmission optical density of 3.4. A linear relationship of the optical densities of the transferred image to those of the original image resulted. The surface of the transferred image was very hard and abrasion resistant. Characterization by SEM indicated that the toner deposit was encapsulated and localized in a domain comprising the uppermost 2 microns of the coating. No particulate matter was visible on the coating surface after transfer in the SEM.

EXAMPLE 6

A sample of a polyester film, 50 microns thick, coated on one side with a cured silicone polymeric low adhesion backsize, was obtained from 3M Industrial Specialties Division. On the untreated side was coated a thin layer of styrene-butadiene copolymer (Goodyear Pliolite® S-7) from a 10 wt% solution of the copolymer in toluene using a No. 10 Meyer Bar. Once this primer layer was dry, it was overcoated with a radiation curable composition comprising:

| | |
|---|---|
| medium MW polymethyl methacrylate (20 wt % DuPont Elvacite® 2008, in dichloromethane) | 110 parts |
| TGD | 26 parts |
| BDK | 1 part |

using the No. 34 Meyer Bar. The resulting coating was approximately 40 microns thick when dry. After drying at 70° C., the coating was still soft and deformable. Sheets of the construction were stacked, and a force of approximately 1 kg/dm$^2$ was applied for several hours to the top of the stack. Subsequently, the sheets could be separated easily without disruption of the active surface owing to the presence of the backsize.

An image comprising a dried deposit of MX 1112 toner (Eastman Kodak Co.), whose particles had a mean diameter of 0.09 micron, and which exhibited a maximum transmission optical density of 1.8, was prepared on a 25 micron thick polyester foil as described in Example 2. The image-bearing substrate and a sample of the radiation curable coating construction were laminated face-to-face at 60° C. While together, they were placed in a graphic arts vacuum frame and irradiated 2 minutes by a 400 watt mercury arc lamp located 30 cm from the receptor side. After irradiation, the donor foil separated easily to leave a smooth, hard coating on the receptor with the toner image incorporated therein. The transferred, cured image exhibited a maximum transmission optical density of 1.7.

EXAMPLE 7

A receptor coating was prepared from a solution comprising a mixture of 0.39 g high molecular weight polymethyl methacrylate (Elvacite® 2041, du Pont Corp.), 1.60 g ECHM, 0.016 g ethyl dimethoxyanthracene, and 0.06 g DIH, wherein the mixture represents about 40% solids in acetone solution. The wet coating was approximately 100 microns thick on blue tinted polyester sheets and dried at room temperature. Images were transferred as in EXAMPLE 6. Again, the encapsulating layer was cured by radiation as in EXAMPLE 3. More than 95% of the toner image particles transferred and were encapsulated in the receptor coating.

EXAMPLE 8

To the lead oxide radiographic construction of EXAMPLE 1 was laminated, as described therein, a 25 micron thick polyester foil. The combination was charged in the same manner to −1 kV, exposed to a 30 mR dosage of 42 kV$_p$ X-rays through a lead foil resolving power test target, and the conformable electrode removed. The resulting charge pattern was developed with LTD. After the toner deposit had dried sufficiently to present a matte appearance, the polyester foil bearing the image was removed from the construction. The image resolution was determined to be 9 lp/mn, and its maximum transmission optical density was 1.9.

A receptor coating was prepared by coating the following composition:

| | |
|---|---|
| resin* (Rhom & Haas WR-97, 35 wt % in isopropanol) | 2.5 parts by wt. |

-continued

| | |
|---|---|
| HHA | 0.9 parts by wt. |
| low MW alkyd plasticizing agent (Goodyear Paraplex ® G-30, Goodyear Corp.) | 0.2 parts by wt. |
| BDK | 0.1 parts by wt. |
| Toluene | 11.3 parts by wt. |

*believed to be a methyl methacrylate/butyl acrylate/2-hydroxyethyl acrylate terpolymer on 175 micron thick blue tinted polyester film. After thorough drying, the coating was laminated with the image-bearing foil in the apparatus of EXAMPLE 1 with the heated roller at 85° C. The laminated combination was then irradiated through the receptor substrate for 2 minutes in a graphic arts vacuum frame (400 watt mercury source, 30 cm lamp-to-frame distance). Thereafter the donor foil was easily stripped away to leave a hard receptor coating with the toner image encapsulated therein. This image continued to exhibit 9 lp/mm resolution. The maximum net developed transmission optical density was reduced to 1.1, although no material remained on the donor foil.

EXAMPLE 9

A receptor was prepared from a solution comprising 2 g of Epon ® 1001 (TABLE I, footnote c) in 8 g of 1,1,2-trichloroethane. The wet coating was approximately 100 microns thick on blue tinted polyester film and dried to approximately 14 microns thick. Simulated images were prepared as described in EXAMPLE 2. The receptor coating was then drawn face-to-face with the image bearing substrate at a speed of 0.25 cm $sec^{-1}$ between laminator rolls heated to 130° C. as in EXAMPLE 1. It was found by substituting fine particles of materials of calibrated melting points (Tempilstiks ®, Big Three Industries, Inc.) for the toner that the temperature at the donor-receptor interface was thus 73°±5° C. Three runs were performed. In the first, the image bearing substrate developed with liquid toner was placed in contact with the coating immediately after development (wet); in the second after the surface was substantially free of dispersant but before a matte appearance was achieved (partially dry); and in the third, after drying to an effectively dispersant free condition which left a matte appearing toner deposit (dry). In all cases the toner image was successfully transferred to the receptor coating yielding net optical densities as indicated in TABLE III. Crockmeter tests, as described above, confirmed that the toner deposit was encapsulated in all instances.

A second receptor was prepared from a hot melt of carnauba wax on 175 micron thick, blue tinted polyester film to a coating thickness of ca 3 microns. The image bearing substrate was developed and allowed to dry to varying degrees of dryness as described above. Transfer was accomplished as in EXAMPLE 1. Encapsulation occurred only with effectively dispersant free toner images to yield a net transferred optical density of approximately 1.8.

These data, as shown in TABLE III, indicate that the ability to transfer an incompletely dried liquid toner deposit by encapsulation is dependent on the specific composition of the receptor coating.

TABLE III

| Receptor | Toner Deposit | Original Density | Transferred Density | % | Crockmeter Values |
|---|---|---|---|---|---|
| Epon ® 1001 | Dry | 2.63 | 2.20 | 84% | 0.18 |
| Epon ® 1001 | Partially Dry | 2.87 | 2.45 | 85% | 0.18 |
| Epon ® 1001 | Wet | 3.87 | 3.24 | 84% | 0.17 |
| Carnauba Wax | Dry | 2.15 | 1.83 | 85% | 0.15 |
| Carnauba Wax | Partially Dry | — | * | — | — |
| Carnauba Wax | Wet | — | * | — | — |

*no transfer

EXAMPLE 10

To a magnetic pattern consisting of an area of 3M Plastiform ® magnetic material, comprising, in turn, an array of magnetic poles, spaced 6.7 per cm, in a flexible polymeric medium, was laminated a 25 micron thick polyethylene film. A liquid developer was prepared by dilution of Lignosite ® ferro fluid (Crown Zellerbach, Inc.), comprising 80 A magnetite particles dispersed in water with the aid of a lignin sulfonic acid surfactant, to about 1% solids, and addition of a few drops of a nonionic wetting agent (Eastman Kodak Photo-Flo ®). The magnetic pattern was developed on the polyethylene surface, by application of the developer thereto; the excess was removed in an air-stream and the water was evaporated by application of heat. The image-bearing polyethylene support was then removed from the magnet array.

A sample of the receptor coating of EXAMPLE 6 was preheated to 70° C. and laminated to the polyethylene film bearing the magnetite image. The combination was cured 2 min by irradiation in a vacuum frame as described in that EXAMPLE. The polyethylene support was then stripped away to leave the magnetite particles encapsulated in image-wise fashion in the hard receptor coating.

EXAMPLE 11

A micro-image was formed on a sample of organic photoconductive material (S0-102, Eastman Kodak Co.) by projecting a 24X reduced image of a resolving power test target. It was developed with a liquid toner comprising a dispersion of sub-micron, non-thermoplastic pigment particles dispersed in a mixture of medium molecular weight aliphatic hydrocarbons. The dispersant was allowed to evaporate. The dried image was laminated to a 10 micron thick coating of the SIA resin of TABLE I, footnote(d), on 175 micron thick polyester photographic film base in the apparatus of EXAMPLE 1. The surface temperature of the heated roller was 115° C.; a pressure of 5 $kg/cm^2$ was applied; and the transfer rate was 0.5 cm/sec. The receptor coating was removed from the photoconductive donor to reveal essentially complete transfer of the image, which was encapsulated and exhibited 150 lp/mm resolution.

What is claimed is:

1. A method of electrography comprising the steps of:

(a) providing a substrate carrying a liquid toner image on at least one surface thereof, (b) removing up to 100% of the liquid dispersant from said liquid toner image so that the toner material is converted to a dried toner image composition of submicron size particles comprising at least 50% by weight solids, (c) bringing said dried toner image into contact with a soft or softenable receptor coating in the range of 3 to 100 microns thick on a substrate, applying pressure so that said dried toner image undergoes linear transfer and becomes encapsulated as a homogeneous continuum of particles within the soft or resulting softened receptor coating with at least 75% of the transferred particles not protruding from the surface, the material comprising said soft or softened receptor coating having a Newtonian complex dynamic melt viscosity of less than about $1.7 \pm 0.2 \times 10^3$ poise and a loss tangent greater than 10 at the temperature of transfer, and (d) hardening the receptor coating.

2. A method of claim 1 wherein said toner image is an electroradiographic image.

3. A method of electrography according to claim 1 wherein the liquid toner developed image is formed by development of an electrostatic charge pattern with a finely divided solid opaque charged or polarizable pigment material which is dispersed in a suitable high resistivity organic liquid.

4. A method of electrography according to claim 1 wherein the liquid toner developed image is formed by development of a magnetic pattern with a finely divided opaque magnetic or magnetizable pigment material dispersed in a suitable liquid.

5. A method according to claim 1 wherein the image-carrying substrate is a photoreceptor capable of bearing an electrostatic charge pattern.

6. A method according to claim 1 wherein the image-carrying substrate is an insulating substrate onto which a charge pattern has been transferred or directly sprayed.

7. A method according to claim 1 wherein the receptor coating is 10 to 50 microns thick.

8. The method according to claim 1 wherein the temperature of transfer is between 20° and 130° C.

9. The method according to claim 1 wherein the temperature of transfer is between 20° and 70° C.

10. A method according to claim 1 wherein the receptor coating is radiation curable.

11. A method according to claim 11 wherein the radiation is ultraviolet.

12. A method according to claim 1 wherein the receptor coating hardens when cooled to room temperature.

13. A method according to claim 1 wherein the resulting encapsulated image exhibits continuous tone and transmission optical densities within the range of 0 to 4.0.

14. A method according to claim 1 wherein the resulting encapsulated image is capable of maximum transmission optical density of at least 3.0.

15. A method according to claim 1 wherein said substrate and said soft or softenable receptor coating are optically transparent.

16. A method according to claim 1 wherein said toner developed image exhibits resolution up to about 200 lp/mm.

17. The method of electrography according to claim 1 wherein said contact step further comprises applying heat.

18. The method of claim 1 wherein the resulting encapsulated image comprises at least some toner particles extending to a depth of 3 microns into the receptor coating.

19. The method of claim 1 wherein said toner image is a micro-image.

20. The method according to claim 1 wherein at least some of said toner particles become encapsulated in said receptor coating up to a depth of 3 microns.

21. The method according to claim 20 wherein removal of liquid dispersant renders said dried toner image substantially free of dispersant.

22. A stable, abrasion-resistant electrographic article comprising a substrate bearing a polymeric receptor coating, said receptor coating having encapsulated therein particles of substantially submicron size distributed in image-wise fashion in a homogeneous continuum up to about eight particle-diameters thick and having a resulting transmission optical density range of at least 0 to 4.0, said particles being encapsulated in said coating so that at least 75% are not protruding from the surface of the coating.

23. An electrographic article according to claim 22 wherein said receptor coating has a transmission optical density range of at least 0 to 3.0.

24. An electrographic article according to claim 22 wherein said receptor coating has a transmission optical density range of at least 0 to 2.0.

25. An electrographic article according to claim 22 wherein said receptor coating has a transmission optical density range of at least 0 to 1.5.

* * * * *

UNITED STATES PATENT AND TRADEMARK OFFICE

CERTIFICATE OF CORRECTION

PATENT NO. : 4,337,303

DATED : June 29, 1982

INVENTOR(S) : Melville R. V. Sahyun, et al.

It is certified that error appears in the above—identified patent and that said Letters Patent is hereby corrected as shown below:

Col. 7, Sample No. 18 of TABLE I, replace "Carnabu" with

--- Carnauba ---.

Col. 16, line 26, replace "Photo-Flo®" with

--- Photo-Flo® 200 ---.

Signed and Sealed this

*First* Day of *March 1983*

[SEAL]

*Attest:*

GERALD J. MOSSINGHOFF

*Attesting Officer*

*Commissioner of Patents and Trademarks*